US005430356A

United States Patent [19]

Ference et al.

[11] Patent Number: 5,430,356

[45] Date of Patent: Jul. 4, 1995

[54] PROGRAMMABLE LIGHTING CONTROL SYSTEM WITH NORMALIZED DIMMING FOR DIFFERENT LIGHT SOURCES

[75] Inventors: Jonathan H. Ference, Riegelsville; Frederick J. Lind, III, Macungie, both of Pa.

[73] Assignee: Lutron Electronics Co., Inc., Coopersburg, Pa.

[21] Appl. No.: 131,825

[22] Filed: Oct. 5, 1993

[51] Int. Cl.[6] ..... G05F 1/00

[52] U.S. Cl. ..... 315/291; 315/294; 315/307; 315/314; 315/DIG. 4; 315/DIG. 7

[58] Field of Search ..... 315/291, 293, 294, 297, 315/307, DIG. 4, DIG. 7, 314

[56] References Cited

U.S. PATENT DOCUMENTS

| | | | |
|---|---|---|---|
| 4,797,599 | 1/1989 | Terence et al. | 315/DIG. 7 X |
| 5,099,193 | 3/1992 | Moseley et al. | 315/291 X |
| 5,191,265 | 3/1993 | D'Aleo et al. | 315/295 |
| 5,248,919 | 9/1993 | Hanna et al. | 315/291 |
| 5,264,761 | 11/1993 | Johnson | 315/291 |

*Primary Examiner*—Robert J. Pascal
*Assistant Examiner*—Haissa Philogene
*Attorney, Agent, or Firm*—Seidel Gonda Lavorgna & Monaco

[57] ABSTRACT

A lighting control system is adapted to dim a plurality of groups of light sources in a room to any one of a number of different preset levels to achieve a like number of different lighting scenes. Each group of light sources defines a lighting zone of the same type of light source, for example, incandescent lamps, fluorescent lamps, neon lights, etc. The system includes a plurality of dimmers for adjusting the respective light levels of the different lighting zones, and a display panel for displaying the instantaneous light level of each zone. According to the invention, a suitably programmed microprocessor or the like operates to normalize the system's dimming performance for a plurality of different types of light sources so that a given change in dimmer setting produces the same change in perceived light level from each of the different types of light sources. Preferably, a system user inputs the type of light source used in each zone by a software scheme that operates the light level indicators of the display panel in an alternative mode to indicate the various types of light sources.

17 Claims, 9 Drawing Sheets

PROGRAMMABLE LIGHTING CONTROL SYSTEM WITH NORMALIZED DIMMING FOR DIFFERENT LIGHT SOURCES

BACKGROUND OF THE INVENTION

The present invention relates to improvements in lighting control apparatus of the type adapted to dim a plurality of different types of light sources (e.g. incandescent, fluorescent, neon, etc.) and to provide a visual indication of the instantaneous level of dimming, for example, by the number of lights illuminated in a linear array of LED's (light-emitting diodes) or the position of a potentiometer slider (used to set the dimming level) in a linear track.

Commonly assigned U.S. Pat. Nos. 4,575,660; 4,924,151; and 5,191,265 disclose various lighting control systems in which groups of lights, defining a lighting zone, are varied in brightness to produce several different scenes of illumination. The level of brightness of the lights constituting each lighting group is displayed to the user by either the number of LED's illuminated in a linear array of LED's, or the position of a potentiometer slider in a linear track. For example, if the number of LED's in the array is ten, illuminating six LED's would indicate that the lights in a particular zone are operating at 60% of maximum brightness. Similarly, if the position of the dimmer actuator (slider) is set at about three-tenths of its maximum allowed movement, the perceived light level will be at about 30% of maximum. So long as all light sources are of the same type, e.g. all incandescent, the light level indicators of the above lighting control systems accurately reflect the instantaneous lighting levels of the different lighting zones. But, when the light sources differ from zone-to-zone, the accuracy of the light level display is compromised. Moreover, a given change in dimmer setting will not produce the same change in light output form of the different sources.

To understand the problem alluded to above, one must understand that such dimmers operate by a phase control scheme in which the power applied to a light source from an AC power source is interrupted each half-cycle by a predetermined phase angle, the larger the angle, the lower the power applied to the source and, hence, the lower its brightness. The power interruption may be at the beginning of each half-cycle, in the middle or at the end (as in the case of reverse phase control). The maximum and minimum allowable phase angles (which determine the minimum and maximum brightness, respectively, of a given light source) are characteristics of the particular light source. In the case of an incandescent lamp, the phase angle may be theoretically varied from zero to 180 degrees; however, for a variety of reasons, it is usually desirable to operate at phase angles between about 40 and 160 degrees. In the case of fluorescent lamps, the range of allowable phase angles is narrower, owing to the need to maintain a certain current in the lamp to avoid flicker or extinction of the gas plasma. A typical operating range of phase angles for fluorescent lamps is between about 50 and 120 degrees. Other types of lamps, notably neon, have a different and even narrower range of acceptable phase angles for maximum and minimum light output, a typical range for neon lamps being between about 70 and 130 degrees. It is these different ranges of acceptable phase angles that give rise to the aforementioned problems of the above lighting control systems. If, for example, the potentiometer slide is normalized for an incandescent source, movement of the slider from one end of its track to the other will cause the phase angle to change by a total of 120 degrees. If, instead of an incandescent source, a fluorescent source is and in the same zone, the first 30% of the slider movement will be dead travel, and no change in light output will occur until the phase angle reaches 120 degrees. The same effect occurs, to a lesser extent, at the upper end of the slider movement. Similarly, if the aforementioned ten LED display is set up for incandescent lamps and other types of lamp (e.g. fluorescent) are used, the bottom three LED's will be energized, indicating 30% light level when, in fact, the fluorescent source will not yet have begun to radiate energy.

SUMMARY OF THE INVENTION

In view of the foregoing discussion, an object of this invention is to provide an improved lighting control system of the above type, one that is improved from the standpoint that its dimming performance is not dependent on the type of light source it controls.

Another object of this invention is to provide a lighting control system of the above type which is adapted to simultaneously change the perceived lighting level of different types of light sources by the same amount for a given change in a master dimmer setting.

Still another object of this invention is to provide a software-based apparatus by which a system user may input to a microprocessor control the type of light source controlled by the system.

According to one aspect of the invention, a lighting control system comprises:

(a) switching means connected between an AC power source and any of a plurality of different types of light sources, such switching means being operable in either an ON or OFF state to selectively apply power to a light source;

(b) switch control means for controlling the operating state of the switching means, such switch control means including means responsive to changes in a dimming control signal for adjusting the phase angle at which said switch changes its ON/OFF state during each half-cycle of the AC waveform produced by the AC power source, whereby the power applied to said light source is adjustable between a minimum and maximum level, such phase angle being within a range which differs for each light source type in order to achieve maximum and minimum light output;

(c) display means, preferably a linear array of LED's, for displaying the instantaneous light level of a light source controlled by the system over a predetermined range of values; and (d) normalizing means for normalizing the system performance for different types of light sources so that said display means displays the instantaneous light level for all of said different types of light sources over the same predetermined range of values. Preferably, such normalizing means comprises a microprocessor which operates to normalize the phase angle versus perceived light level curves for the different types of light sources.

According to another aspect of the invention, the normalizing means operates to normalize the system performance so that the percent of allowed movement of a dimmer slide actuator in a track reflects the same percentage of light level of various different types of light sources.

According to a third aspect of the invention, the normalizing means operates to normalize the system performance so that a given change in a light level setting effects the same change in perceived light level for a plurality of different light sources.

According to another aspect of this invention, a system user inputs to a logic and control device (e.g. a suitably programmed microprocessor) the light source type used in each lighting zone by a software routine that employs the light level display (e.g. a linear array of LED's) as a means for selecting the light source type from among several types. This approach obviates the need for an electro-mechanical selector switch or other hardware for inputting the type of light source to the microprocessor.

According to yet another aspect of this invention, means are provided for adjusting the normalized dimming curves so that, at the lowest light level setting, the lowest possible light output is provided from any of a plurality of different light sources.

The invention and its advantages will be better understood from the ensuing detailed description of preferred embodiments, reference being made to the accompanying drawings in which like reference characters denote like parts.

DETAILED DESCRIPTION OF PREFERRED EMBODIMENTS

Figure 1:
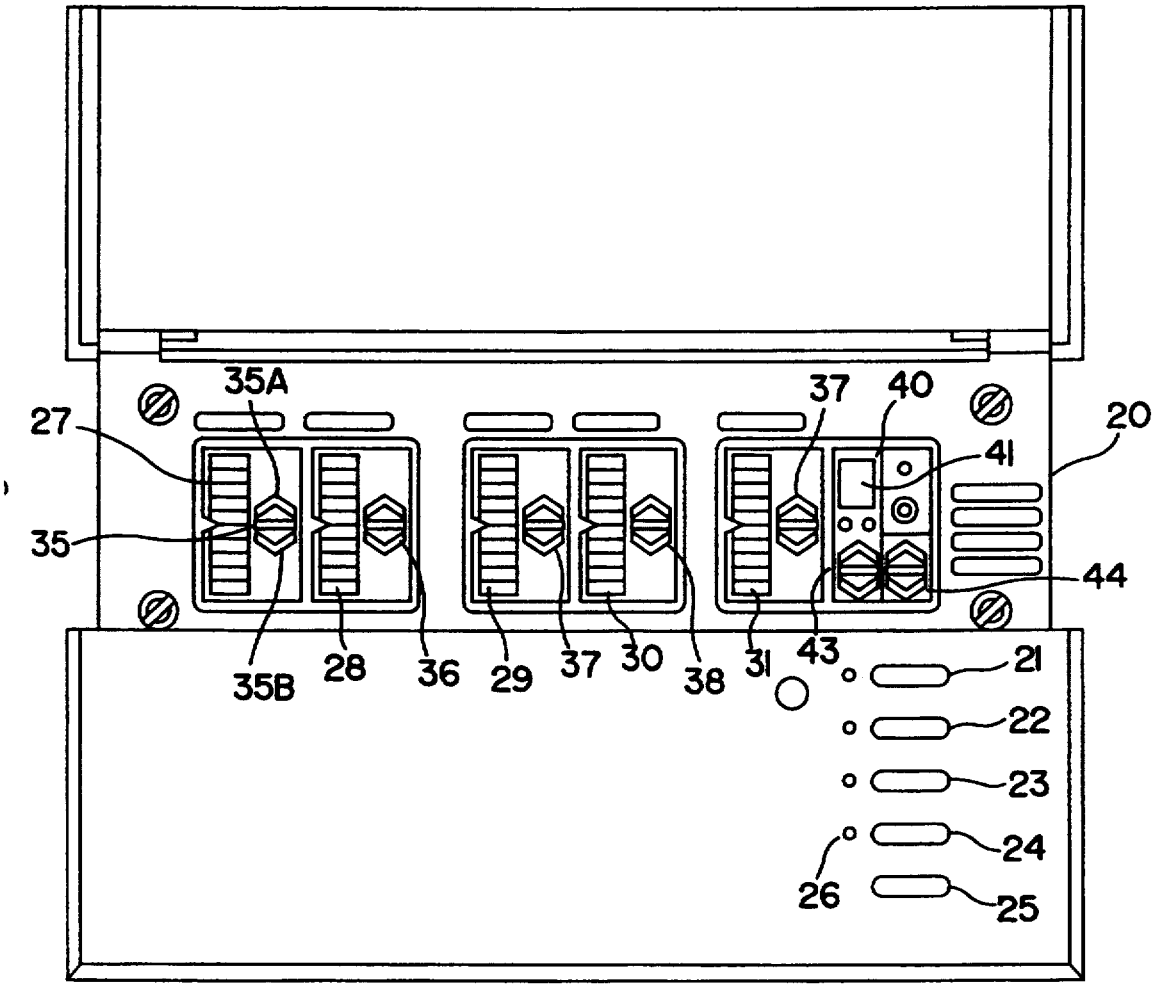
FIG. 1 is a front view of a multi-zone lighting control panel.

Referring now to the drawings, FIG. 1 illustrates a control panel 20 of a lighting control system which is adapted to adjust each of five different zones of light to one of four different preset levels or "scenes". A zone of light is defined by one or more light sources of the same type (e.g. incandescent, fluorescent, neon, magnetic low voltage) that are commonly controlled. For example, consider a five zone conference room arrangement in which zones one and two are defined by two different banks of fluorescent ceiling lights, zone three is defined by a plurality of incandescent wall washers, zone four is defined by a neon special effect lamp, and zone five is defined by a plurality of magnetic low voltage soffet lights. Various ON/OFF and intensity combinations of these zones may be imagined, each defining a possible lighting scene. Thus, scene one might be defined by zones one and two (the ceiling fluorescent lamps) at 85% of maximum intensity, zone three at maximum intensity, and zones four and five OFF. This scene may be used, for example, for normal discussions within the conference room. Scene two may be an audio/visual scene in which the fluorescent ceiling lights (zones one and two) are at 20% intensity, the incandescent wall washers (zone three) at 40% intensity, and the neon and magnetic low voltage lamps at 50% intensity. Scene three may be a social function scene in which the two fluorescent zones are at 30% and 50%, respectively, the incandescent zone is at 60%, and the neon and magnetic low voltage zones are at 70% each. Scene four may be a clean-up scene in which all lighting zones, except the neon zone, are full ON.

The control panel shown in FIG. 1 is of the type disclosed in the aforementioned U.S. Pat. No. 5,191,265, the disclosure of which is incorporated herein by reference. Panel 20 includes a plurality of scene-select push buttons 21–24 for selecting any one of the above four scenes, and an all OFF button 25 for turning all of the light sources OFF. The particular scene selected is indicated by four status-indicating LED's 26, one for each scene. The relative light intensity of each of the five lighting zones is displayed by five LED arrays, 27–31, each comprising a vertically arranged array of ten selectively energizable LED's. Ideally, the number of LED's energized in an array provides a bar-chart indicating the relative brightness of the lighting zone associated with that array. For example, if the bottom three LED's are energized in zone two (e.g. array 28), this should indicate that the light sources in this zone are operating at 30% of maximum output. The light level of each zone is adjustable, up and down, by pressing either of the appropriate chevron-shaped actuators (e.g. 35A or 35B) of the up/down switches 35–39. As disclosed in the aforementioned patent, the control panel also includes a fade-rate module 40 by which the user may select a time interval over which the light level fades from OFF to a preset level, or vice-versa. The fade time interval is displayed on a liquid crystal display 41 which is adapted to display two digits (or letters) on two seven-segment displays. The fade time can be adjusted (increased or decreased) by an up/-down selector switch 43. The control panel also includes a zone-override switch 44 by which a user may cause all lighting zones to simultaneously increase or decrease in brightness. Ideally, when switch 44 is actuated, the perceived light level in all zones should change by the same amount, regardless of source type. For the reasons discussed below, such a uniform change in light level cannot be attained unless all zones comprise light sources of the same type.

Figure 2:
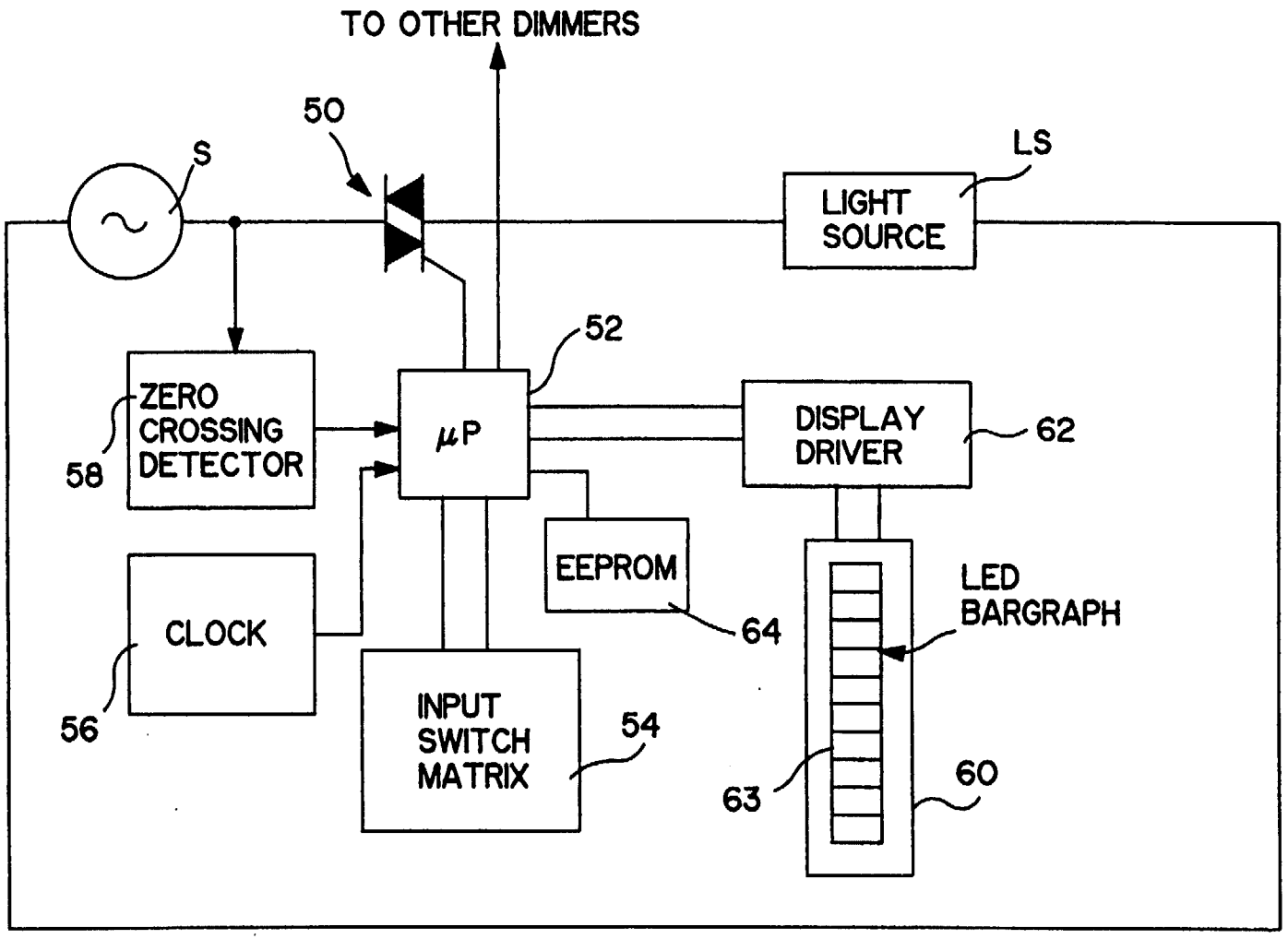
FIG. 2 is a functional block diagram of apparatus embodying the invention.

Referring to FIG. 2, a single zone lighting control apparatus of the invention is illustrated as comprising a switching device 50, shown as a triac, having its power leads connected to an AC power source S and a light source LS. The triac's gate lead, which controls the ON/OFF state of the triac, is connected to a logic and control unit 52, shown as a conventional microprocessor Up. During each half-cycle, the latter serves to turn the triac ON after a phase angle determined by the type of light source it controls (e.g. incandescent, fluorescent, neon, etc.) and the desired light level, as determined by a control signal produced by input switch matrix 54 (e.g. one of the up/down switch 35–39). The control signal is preferably in digital form and, for example, may have any one of 255 values (assuming an 8 bit input). Timing for the microprocessor's operation is provided by a crystal clock 56 and a zero-crossing detector 58 connect to the AC source. The microprocessor also controls a light-level display 60 (e.g. one of the displays 27–31) via a display driver 62. As shown, the light level display preferably comprises a liner LED display 63. An EEPROM 64 or the like serves to store information representing the dimming curves (shown in FIGS. 4A and 4B) for each of a plurality of different light sources.

Figure 3A:
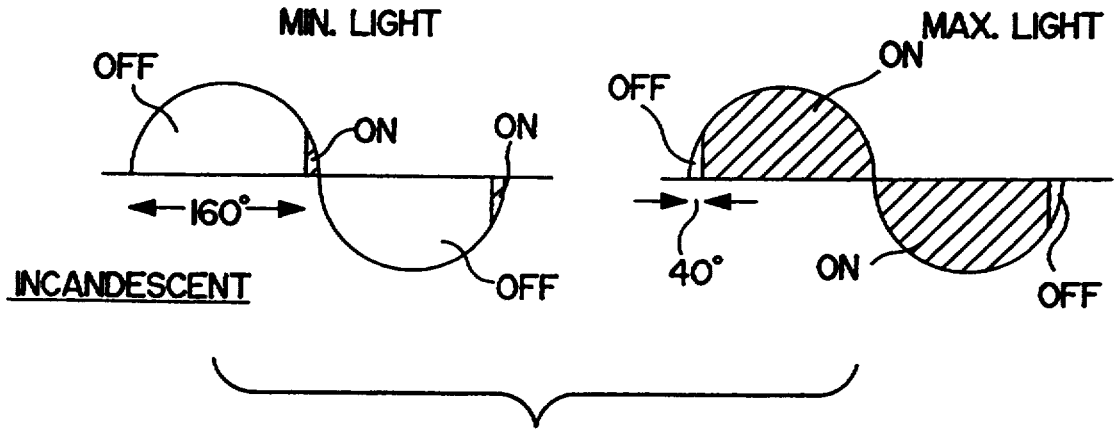
FIGS. 3A–3C are phase angle versus time curves which are useful in understanding the problem solved by the invention.
Figure 3B:
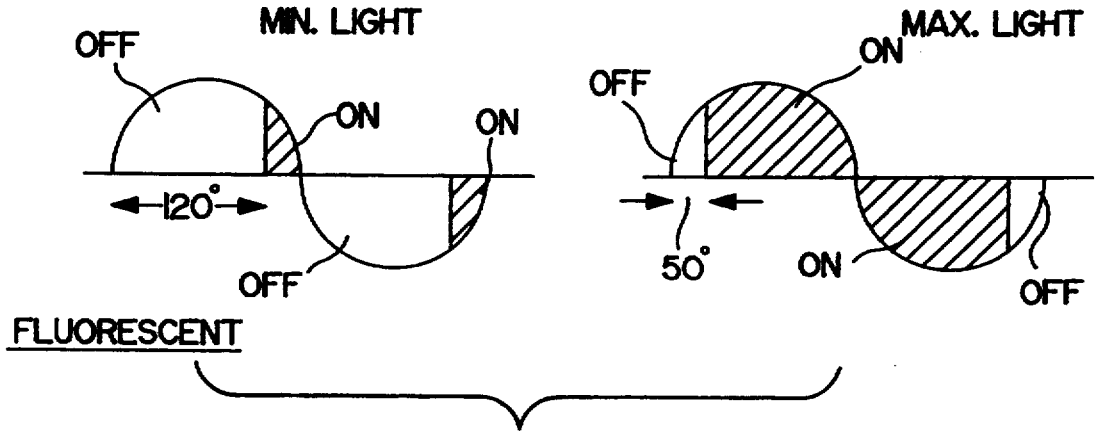
Figure 3C:
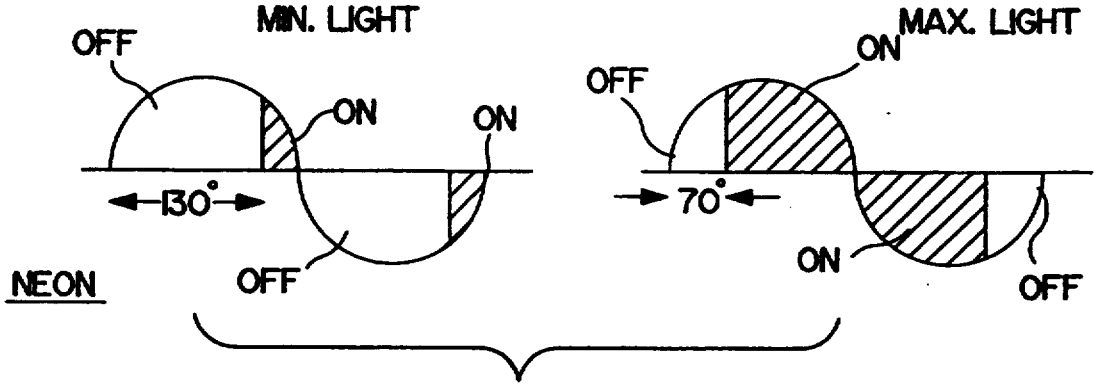

As noted earlier, each type of light source has a characteristic range of phase angles through which its light output can be between a maximum and minimum level. As shown in FIGS. 3A–3C, a typical range of acceptable phase angles for incandescent, as well as magnetic low voltage light sources is from 40 to 160 degrees; for a fluorescent light source, an acceptable range is from 50 degrees to 120 degrees; and for a neon lamp the range is from 70 degrees to 130 degrees. It will be appreciated that, were the microprocessor to apply the incandescent range of phase angles to a fluorescent light source, there would be no change in light level from the fluorescent light source at extreme ends of the phase angle range (i.e. between 40 degrees and 50 degrees, and between 120 degrees and 160 degrees. For example, if the phase angle applied to a fluorescent lamp exceeds 120 degrees, the lamp cannot turn ON, but its intensity is not under control.

Figure 4A:
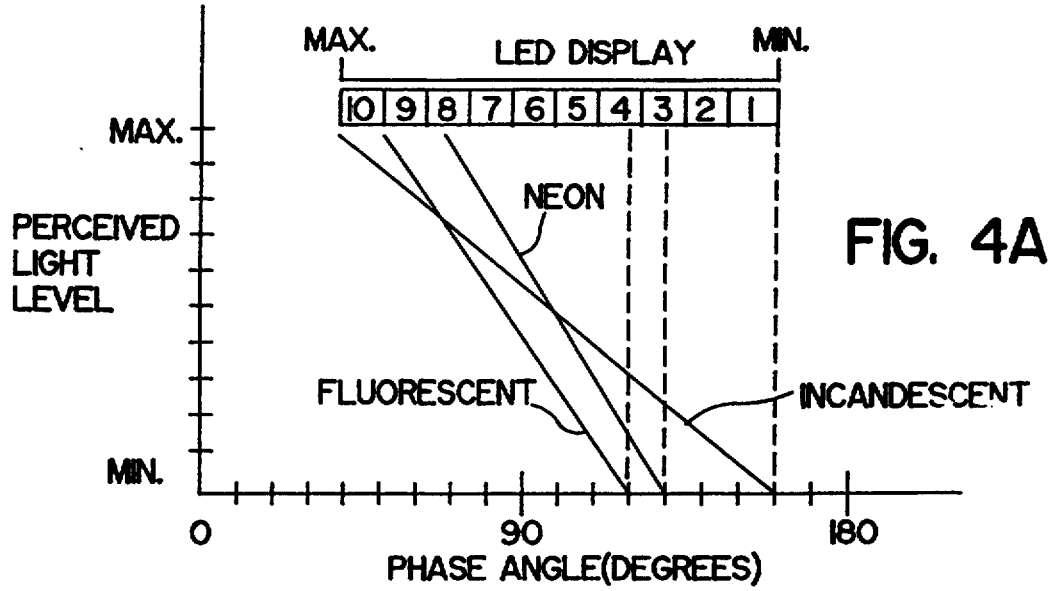
FIGS. 4A and 4B are non-normalized phase angle versus perceived light level curves illustrating the technical problem solved by the invention.
Figure 4B:
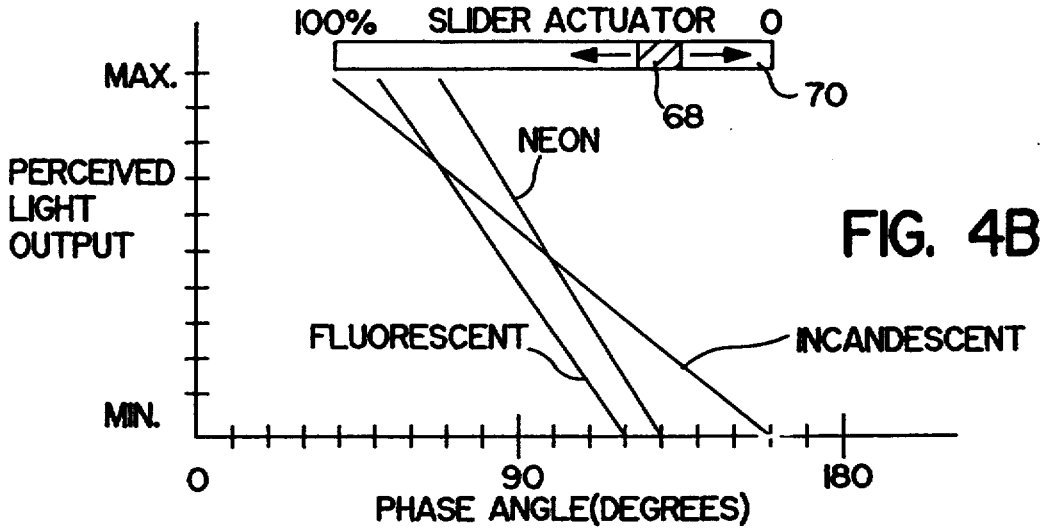
Figure 4C:
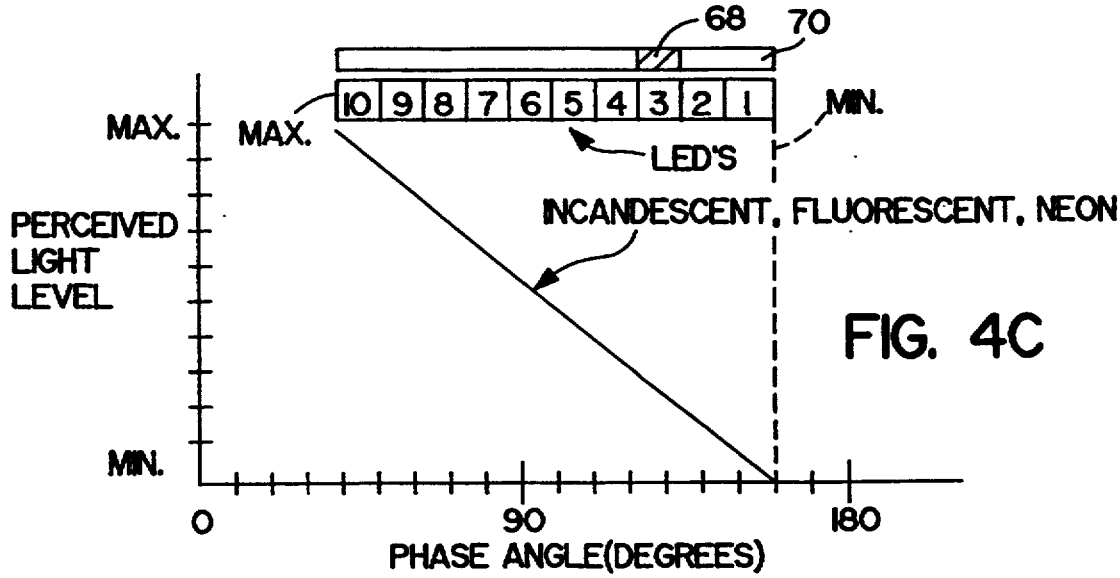
FIG. 4C illustrate phase angle versus perceived light level curves that are normalized for the several types light sources illustrated in FIGS. 4A and 4B.

The effect on the lighting display of the above-noted variation in phase angle range for different types of light sources is shown in FIGS. 4A and 4B where the dimming curves for incandescent, fluorescent and neon lamps are shown. It will be noted that these curves are substantially linear and, hence can be defined by only two pairs of coordinates, for example, the respective phase angles at maximum and minimum light output. It is these pairs of coordinates that are stored in EEPROM 64. Referring to FIG. 4A, it is assumed, for example, that a light level display comprising ten LED's in a linear array is normalized so as to display the entire range of light levels for an incandescent lamp on all ten LED's. Since the range of phase angles for an incandescent source is 120 degrees, one LED in the array is energized for every 12 degree increase in phase angle. Since a fluorescent source has a phase angle range of only 70 degrees (between 50 and 120 degrees), it will be appreciated that, were the same array used to display the perceived light level from a fluorescent lamp, only LED's 4 through 9 would be useful in providing this display. Thus, it will be seen that the potential dynamic range of the display (10 LED's) is compromised for fluorescent and neon light sources, where only six or five LED's, respectively, will reflect in some measure, the light intensity of these sources between their respective minimum and maximum output levels. Not only is the dynamic range of the display significantly reduced for light sources having phase angle ranges narrower than that of an incandescent lamp, but also the information conveyed by the display may well be inaccurate for such lamps. For example, in the case of a fluorescent lamp, the lower three LED's (1–3) in the array will become illuminated (indicating 30% light level) before the fluorescent lamp actually turns ON at its minimum level. Similarly, the tenth LED, if and when energized, will have no significance, since the lamp will be no brighter than indicated by the ninth LED.

In FIG. 4B, a similar effect to that discussed above where a sliding dimmer actuator 68 which slides in a linear track 70 is used both to set the dimming level (or phase angle) of the dimmer circuit shown in FIG. 2 and provide a visual indication of light level. If the actuator movement is set to provide a phase angle range of 120 degrees, as is required for incandescent lamps, it will be seen that if a fluorescent lamp is substituted for the incandescent lamp, the first 30% or so of slider movement will be "dead" travel, having no effect on the fluorescent lamp brightness. Similarly, the last 10% of travel, from 90–100% will not reflect any increase on lamp intensity, as the fluorescent lamp will have reached its maximum output when the slider is at the 90% position.

Now in accordance with the present invention, the dimming performance of the aforedescribed lighting control system is normalized for a plurality of different types of light source so that the LED displays 27–31 and 60, and the dimming level actuator (slide actuator 68 and the up/down switch 35–39) have the same dynamic range for all such light source types. As noted above, the microprocessor stores the maximum and minimum phase angles and, hence, the dimming curves, for each of a plurality of different types of light sources in EEPROM 64. From this information, the microprocessor can calculate the phase angle range required to adjust each source type between minimum and maximum brightness. By dividing this phase angle range for each source type by the number of LED's in the array, the LED array is normalized for each source so that, for example, each LED in a ten LED array represents a 10% change in perceived light level, for any of the programmed types of light sources. If, for example, the maximum dimming range for incandescent light sources is achieved by varying the applied phase angle between 40 and 160 degrees during each half-cycle, the phase angle range is 120 degrees, and the phase angle change per LED is 12 degrees (assuming a ten LED array). If, in the case of a fluorescent source, the phase angle range is only 70 degrees (i.e. between 50 and 120 degrees), the phase angle change per LED is only 7 degrees. Thus, when a lighting zone constitutes fluorescent lamps, the associated LED array will display a 10% change in light level for every 7 degree change in phase angle. Where a slider potentiometer is used to input desired changes in light level, it will be appreciated that, for every 10% change in position, the phase angle applied to an incandescent source will change by 12 degrees, and the phase angle applied to a fluorescent lamp will change by 7 degrees. Since, as noted, the dimming curves are linear, every 10% change in slider position will produce a 10% change in the light level from either source type (i.e. incandescent and fluorescent in the example). Also of significance is the fact that when the (Master zone-override) switch 44 is actuated so as to raise or lower the light level in all zones simultaneously, the perceived light level in each zone changes by the same amount, regardless of source type.

Figure 5:
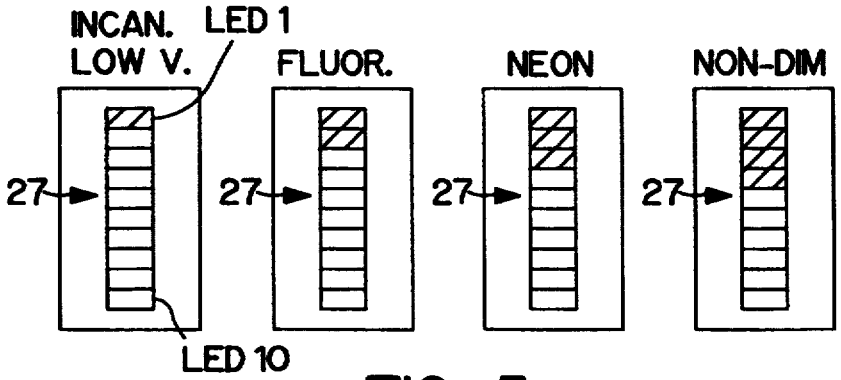
FIG. 5 illustrates a preferred lighting code for displaying different types of light sources on an LED display normally used to display light level.

From the foregoing, it is apparent that the microprocessor must be informed of the light source type used in each lighting zone; otherwise, it would not know which dimming curve to apply. The system user can input the light source type to the microprocessor using a standard mechanical selector switch, whereby a control signal representing a particular source type is applied to the microprocessor. A more preferred approach, however, is to input this source type information by a software routine which eliminates the need for any electromechanical switches or other hardware. In accordance with this aspect of the invention, the LED arrays 27–31 which are normally used to indicate light level in zone, are used in an alternative mode to indicate the various source types for which the microprocessor has a stored dimming code. Referring to FIG. 5, upon entering a light source type programming mode, the microprocessor outputs signals to the LED display of each zone to cause the display to show the light source type for which the microprocessor is currently set to control. In the example shown in FIG. 5, if only the top LED in the array is energized, an incandescent or magnetic low voltage source is indicated (both source type having substantially the same phase angle range). If the top two LED's are energized, the microprocessor is currently set to control a fluorescent source. If the top three LED's are energized, the microprocessor is set to control a neon source. If the top four LED's are energized, the microprocessor is set to control a non-dimmable source. Obviously, any combination of LED's can be used to indicate any one of many different source types for which the microprocessor has been programmed with the associated dimming curve. Should the LED array not reflect the light source type for the lighting zone of interest, the system user "hits" the appropriate up/down switches 35–39 to cause the microprocessor to display a different light source type. When each of the LED arrays accurately reflects the light source type used in all zones, the user exits the light source programming mode by pushing any one of the scene select buttons 21–24 or the all OFF button 25.

Figure 6A:
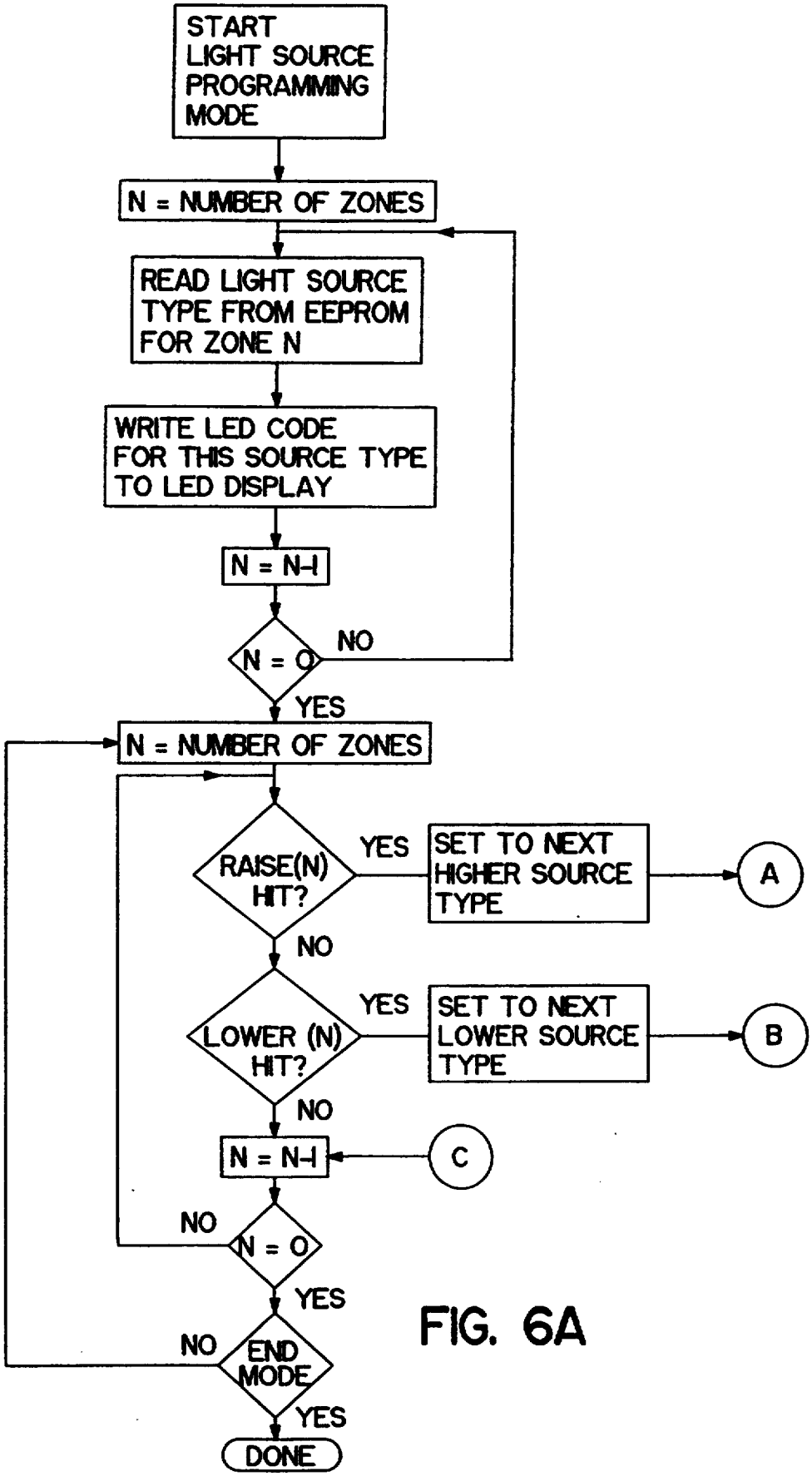
FIGS. 6A–6C are flow charts illustrating a preferred program of steps for inputting the type of light source used in a given zone to the microprocessor.
Figure 6B:
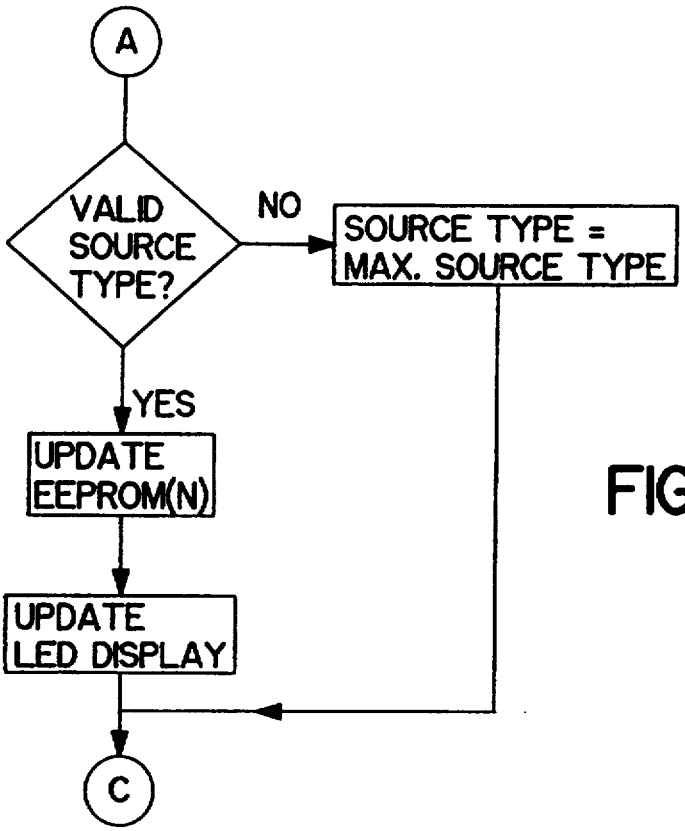
Figure 6C:
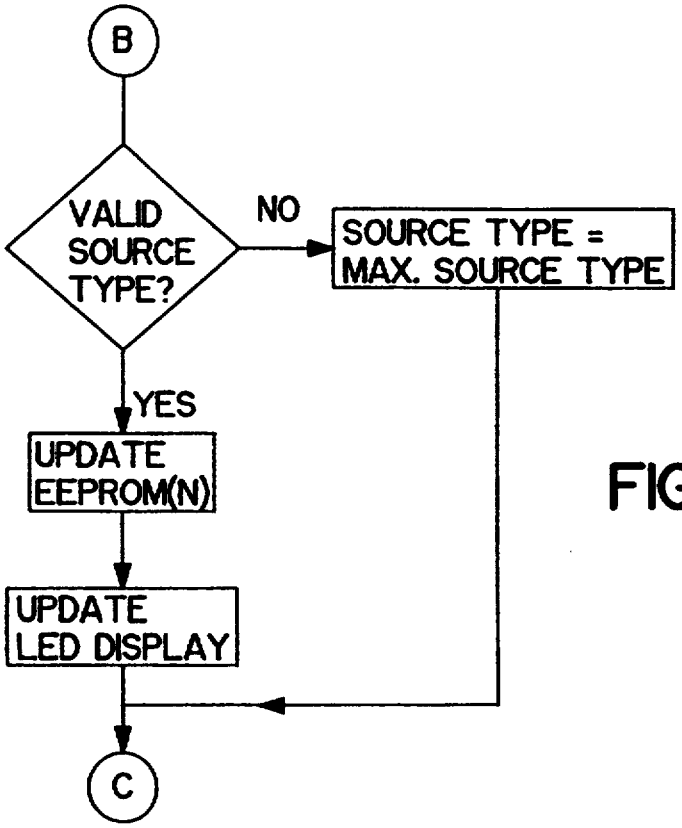

In FIGS. 6A–6C, the flow charts illustrate the sequence of steps carried out by microprocessor 52 in enabling the system user to input the correct light source type. The light source (LS) type programming mode is initiated, for example, by simultaneously depressing push buttons 21 and 25. The user is advised that microprocessor is in its LS programming mode by displaying the letters "LS" on a liquid crystal display 41 which, as mentioned, is normally used to display the currently selected fade time in a two digit display. The microprocessor then reads the current light source type for each zone, one at a time, from EEPROM 55, and displays (i.e. writes) the LED code for each source type on the LED displays 27–31. Upon displaying the LED code for each zone, the user may change the stored light source type by "hitting" either the up or down chevron-shaped switches comprising the up/down switches 35–39. If the LED code for a particular light zone initially displays an incandescent or magnetic low voltage source, in which case only the top LED in the display is energized, and the user intends to use fluorescent lights in this zone, the user hits the lower (i.e. down) chevron, and the microprocessor next lower LED code, i.e. the code in which the top two LED's are energized. Similarly, if the user intends to use a neon lamp in this zone, he again hits the lower chevron, causing the top three LED's to become energized. When the LED code accurately reflects the type of light source used in a zone of interest, the program is ended and the EEPROM is updated with the new light source type. When the LS program mode is initiated again, the LED code written to the LED display will represent the source type now stored in the EEPROM.

Figure 7:
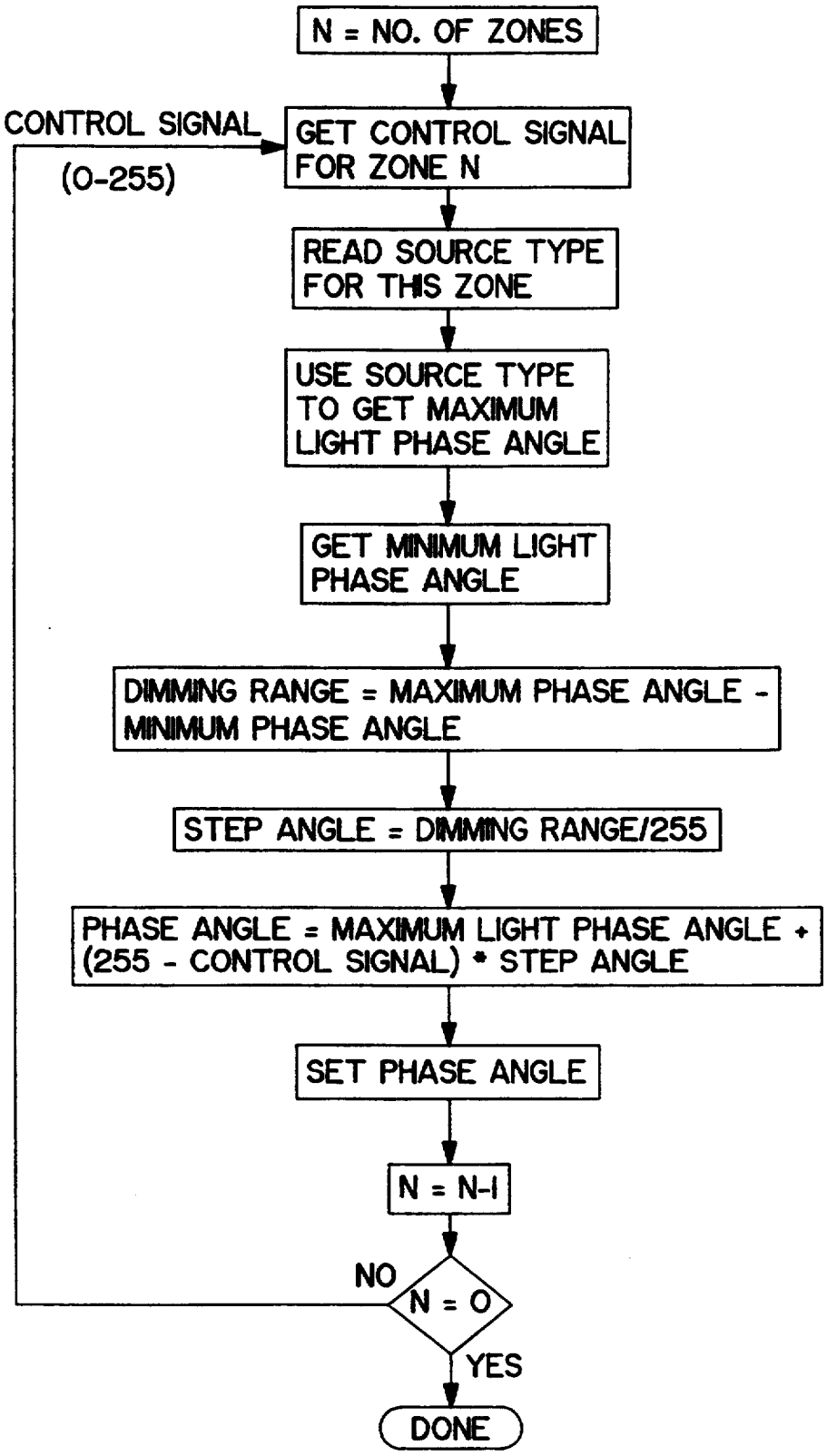
FIG. 7 is a flow chart illustrating a preferred program of steps for providing the normalization function of the invention.

In FIG. 7, the flow chart illustrates the various steps carried out by the microprocessor in normalizing the system performance for different types of light sources. Upon receiving a control signal from the input switch matrix 54, the desired light level is determined. Then, the light source type that has been inputted by the system user (e.g. using the program of FIGS. 6A–6C) is read from the EEPROM for the zone of interest, and the minimum and maximum phase angles are read for this light source type. The dimming (phase angle) range is then determined by subtracting the minimum phase angle from the maximum phase angle, and the resulting dimming range is divided by the number of the levels of the control signal (e.g. 255) to provide "step" phase angle for each increment of the control signal. The phase angle required to provide the desired light level is determined by multiplying the step phase angle by the absolute value of the control signal (i.e. 255—the value of the control signal) and adding the product to that phase angle which produces maximum light output. The microprocessor then produces a signal whereby the triac fires at the calculated phase angle. The program is then repeated for each lighting zone.

Figure 8A:
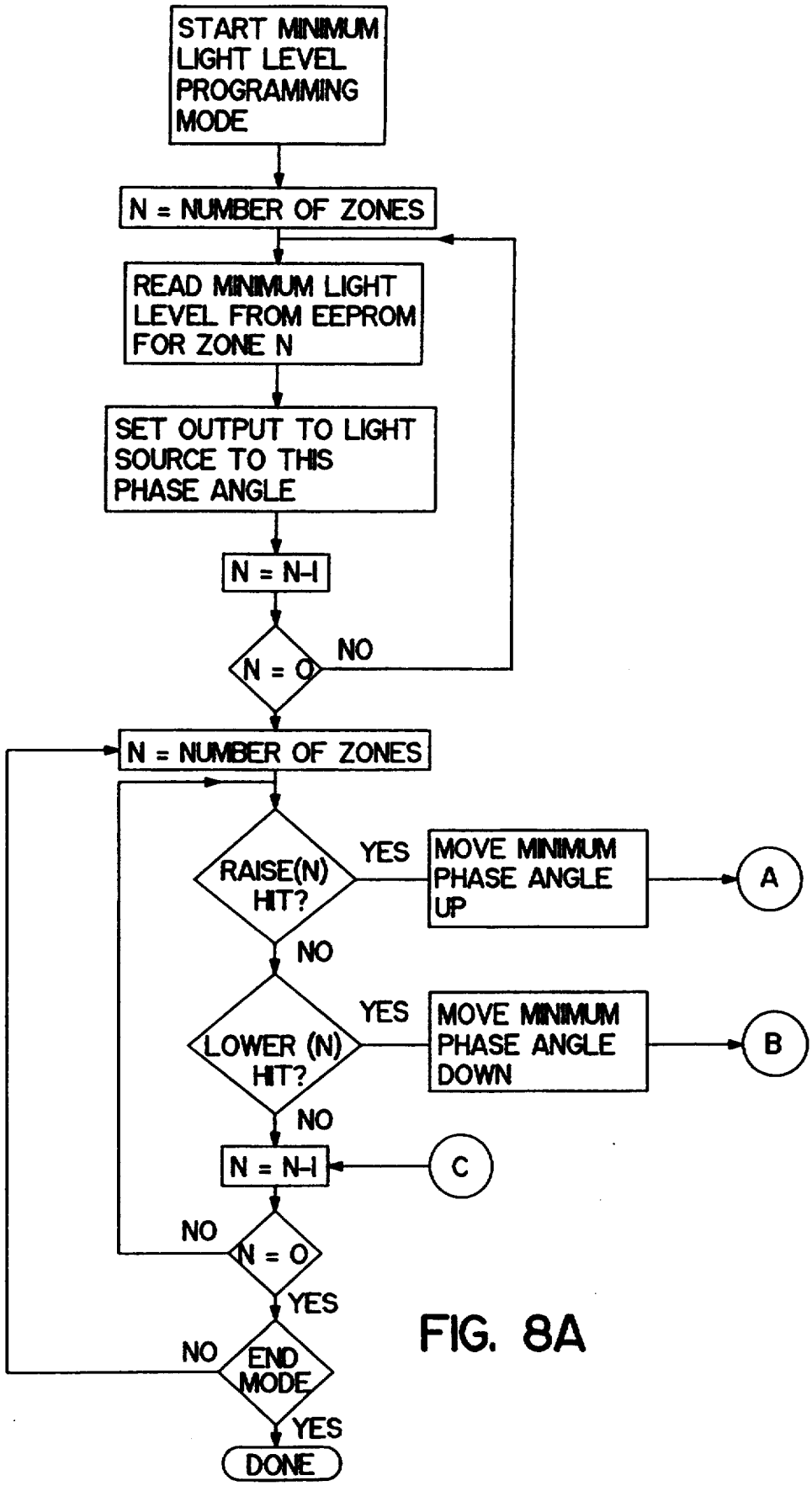
FIG. 8A–8C are flow charts illustrating a preferred program of steps for adjusting the minimum light-level for each light source type.
Figure 8B:
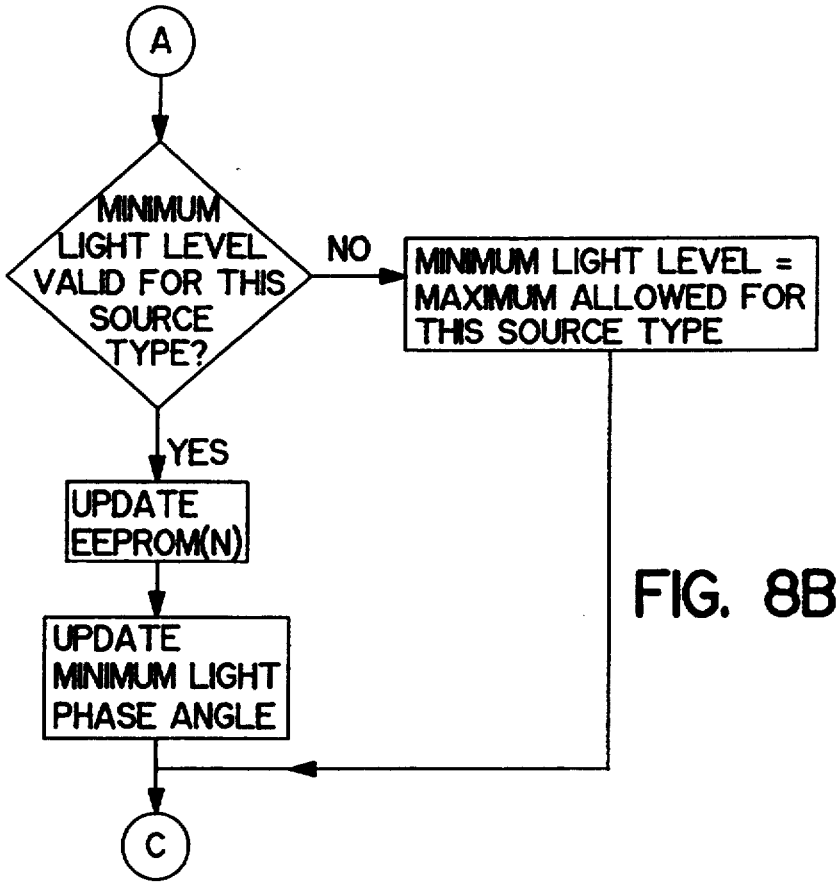
Figure 8C:
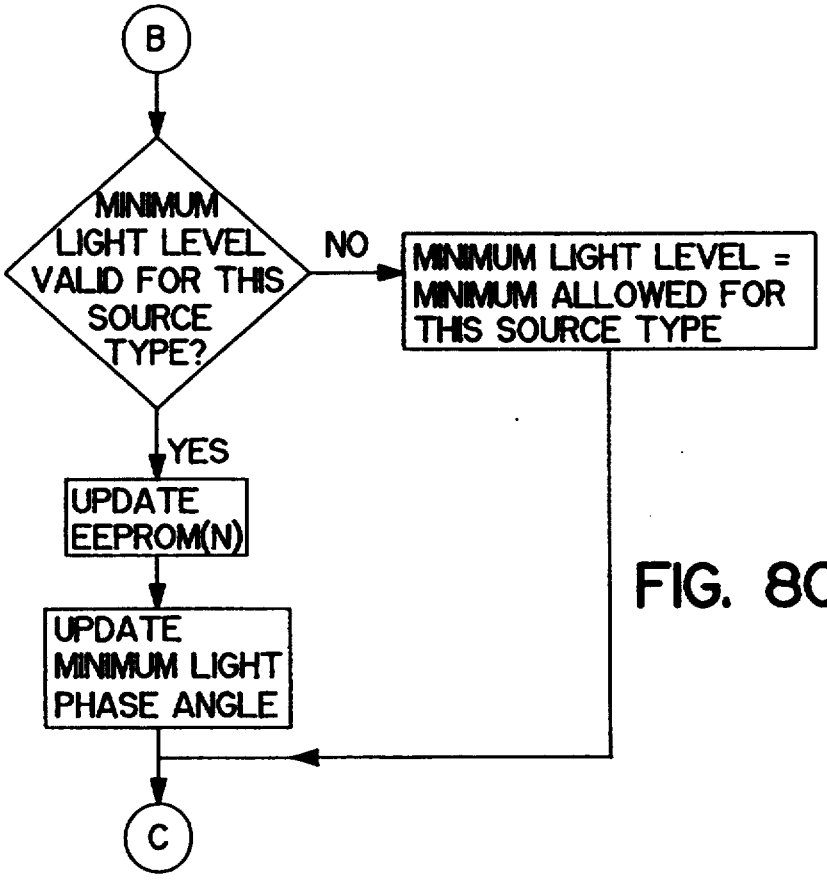

According to another aspect of the invention, the microprocessor is programmed to carry out a process for adjusting the low end or minimum light level for each of the different light source. This allows variation of the desired minimum light output from any light source type to compensate for user preferences, slight lamp differences, fixture differences, while maintaining full dynamic range on the control input/LED display for the adjusted level. The process carried out by the microprocessor is disclosed in the flow charts of FIGS. 8A–8C. Upon entering the "minimum light level" programming mode (e.g. by simultaneously depressing two pushbuttons 21–25), the microprocessor reads the currently set minimum light level stored in the EEPROM by reading the maximum phase angle of the light source of zone 1. It then operates triac 50 at such maximum phase angle, thereby causing the light source(s) of zone 1 to operate at the minimum programmed level. The microprocessor repeats these steps for all lighting zones. If the system user elects to adjust the minimum light level in a given zone, the user "hits" the up/down switches 35–39 to raise or lower the light level. Upon adjusting the minimum light level to a desired level, the microprocessor automatically updates the EEPROM with the minimum light phase angle. The routine may be repeated for each zone. When any one of the pushbuttons 21–25 is depressed, the low end programming mode is terminated.

While the invention has been described with reference to a preferred embodiments, it will be appreciated that many variations can be made without departing from the spirit of the invention, such variations are intended to fall within the scope of the appended claims.

What is claimed is:

1. A lighting control system comprising:

(a) switching means connected between an AC power source and any of a plurality of different types of light sources, said switching means being operable in either an ON or OFF state to selectively apply power to a light source selected from said plurality of different types of light sources;

(b) switch control means for controlling the operating state of said switching means, said switch control means including means responsive to changes in a dimming control signal for adjusting a phase angle at which said switching means changes its OFF state to an ON state during each half-cycle of an AC waveform produced by the AC power source, whereby the power applied to said light source is adjustable between a minimum and maximum level, such phase angle being within a range which differs for each light source type in order to adjust the light output for each light source type between maximum and minimum levels;

(c) display means for displaying an indication of the instantaneous light level of a light source controlled by the system over a predetermined range of values; and (d) normalizing means for normalizing the system performance for different types of light sources relative to said predetermined range of values whereby a selected percentage of light output between said maximum and minimum levels for each light source corresponds to a same indication within said range of values so that said display means displays the instantaneous light level for all of said different types of light sources over the same predetermined range of values.

2. The apparatus as defined by claim 1 wherein said normalizing means comprises a microprocessor which stores information representing a different phase angle versus perceived light level curve for each of said plurality of different types of light sources, and operates to normalize the curves so that said display means has the same dynamic range for each of said different types of light sources.

3. The apparatus as defined by claim 2 further comprising means for inputting to said microprocessor the type of light source controlled by said system, said inputting means comprising means for selectively displaying information representing different light source types on said display means, and means for enabling a system user to input a light source type from among the light source types represented by the displayed information.

4. The apparatus as defined by claim 3 wherein said display means comprises a linear array of light-emitting diodes, and wherein the different light source types are displayed in code by selectively energizing different combinations of said light-emitting diodes.

5. A lighting control system comprising:

(a) switching means connected between an AC power source and any of a plurality of different types of light sources, said switching means being operable in either an ON or OFF state to selectively apply power to a light source selected from said plurality of different types of light sources;

(b) switch control means for controlling the operating state of said switching means, said switch control means including means responsive to changes in the value of a dimming control signal for adjusting a phase angle at which said switching means changes its OFF state to an ON state during each half-cycle of an AC waveform produced by the AC power source, whereby the power applied to said light source is adjustable between minimum and maximum levels, such phase angle being within a range which differs for each light source type in order to adjust the light output from each light source type between maximum and minimum levels;

(c) light-level control means for producing said dimming control signal; and (d) normalizing means for normalizing the system performance for different types of light sources relative to a range of values between said maximum and minimum levels whereby a selected percentage of light output between said maximum and minimum levels for each light source corresponds to the same value of said dimming control signal so that, for a given change in said dimming control signal, the same change in light level is produced for each of said different types of light sources.

6. The apparatus as defined by claim 5 wherein said light-level control means comprises a dimmer actuator mounted for sliding movement in a track, the position of said actuator in said track visually indicating the instantaneous light level and indicating the value of said dimming control signal.

7. The apparatus as defined by claim 5 wherein said normalizing means comprises a microprocessor which stores information representing a different phase angle versus perceived light level curve for each of said plurality of different types of light sources, and said microprocessor operates to cause said control means to have the same dynamic range for each of said different types of light sources.

8. The apparatus as defined by claim 7 further comprising display means for for displaying the instantaneous light level of a light source controlled by the system over a predetermined range of values.

9. The apparatus as defined by claim 8 further comprising means for inputting to said microprocessor the type of light source controlled by said system, said inputting means comprising means for selectively displaying information representing different light source types on said display means, and means for enabling a system user to input a light source type from the displayed information.

10. The apparatus as defined by claim 4 further comprising means for adjusting the minimum output light level for each light source type.

11. A lighting control system comprising:

(a) switching means connected between an AC power source and any of a plurality of different types of light sources, said switching means being operable in either an ON or OFF state to selectively apply power to a light source selected from said plurality of different types of light sources;

(b) switch control means for controlling the operating state of said switching means, said switch control means including means responsive to changes in a dimming control signal for adjusting a phase angle at which said switching means changes its OFF state to an ON state during each half-cycle of an AC waveform produced by the AC power source, whereby the power applied to said light source is adjustable between a minimum and maximum level, such phase angle being within a range which differs for each light source type in order to adjust the light output for each light source type between maximum and minimum levels;

(c) display means for displaying an indication of the instantaneous light level of a light source controlled by the system over a predetermined range of values; and (d) normalizing means for normalizing the system performance for different types of light sources relative to said predetermined range of values whereby a selected percentage of light output between said maximum and minimum levels for each light source corresponds to a same indication within said range of values so that said display means displays the instantaneous light level for all of said different types of light sources over the same predetermined range of values, said normalizing means comprising a microprocessor which stores information representing a different phase angle versus perceived light level curve for each of said plurality of different types of light sources and operates to normalize the curves so that said display means has the same dynamic range for each of said different types of light sources.

12. The apparatus as defined by claim 11, further comprising means for inputting to said microprocessor the type of light source controlled by said system, said inputting means comprising means for selectively displaying information representing different light source types on said display means, and means for enabling a system user to input a light source type from among the light source types represented by the displayed information.

13. The apparatus as defined by claim 12 wherein said display means comprises a linear array of light-emitting diodes, and wherein the different light source types are displayed in code by selectively energizing different combinations of said light-emitting diodes.

14. The apparatus as defined by claim 13, further comprising means for adjusting the minimum output light level for each light source type.

15. A lighting control system comprising:

(a) switching means connected between an AC power source and any of a plurality of different types of light sources, said switching means being operable in either an ON or OFF state to selectively apply power to a light source selected from said plurality of different types of light sources;

(b) switch control means for controlling the operating state of said switching means, said switch control means including means responsive to changes in the value of a dimming control signal for adjusting a phase angle at which said switching means changes its OFF state to an ON state during each half-cycle of an AC waveform produced by the AC power source, whereby the power applied to said light source is adjustable between minimum and maximum levels, such phase angle being within a range which differs for each light source type in order to adjust the light output from each light source type between maximum and minimum levels;

(c) light-level control means for producing said dimming control signal, comprising a dimmer actuator mounted for sliding movement in a track, the position of said actuator in said track visually indicating the instantaneous light level and indicating the value of said dimming control signal; and (d) normalizing means for normalizing the system performance for different types of light sources relative to a range of values between said maximum and minimum levels whereby a selected percentage of light output between said maximum and minimum levels for each light source corresponds to the same value of said dimming control signal so that, for a given change in said dimming control signal, the same change in light level is produced for each of said different types of light sources, said normalizing means comprising a microprocessor which stores information representing a different phase angle versus perceived light level curve for each of said plurality of different types of light sources, and said microprocessor operates to cause said control means to have the same dynamic range for each of said different types of light sources.

16. The apparatus as defined by claim 15, further comprising display means for displaying the instantaneous light level of a light source controlled by the system over a predetermined range of values.

17. The apparatus as defined by claim 15, further comprising means for inputting to said microprocessor the type of light source controlled by said system, said inputting means comprising means for selectively displaying information representing different light source types on said display means, and means for enabling a system user to input a light source type from the displayed information.

* * * * *